US005251570A

United States Patent [19]

Creech

[11] Patent Number: 5,251,570

[45] Date of Patent: Oct. 12, 1993

[54] MULTIPURPOSE SCOREBOARD SYSTEM

[75] Inventor: Eugene Creech, Plattsburg, N.Y.

[73] Assignee: Eagle Scoring Systems, Reno, Nev.

[21] Appl. No.: 825,024

[22] Filed: Jan. 24, 1992

[51] Int. Cl.[5] ..... G09F 11/00; A63F 9/00

[52] U.S. Cl. ..... 116/225; 40/489; 273/DIG. 26

[58] Field of Search ..... 116/222, 225, 306, 307; 273/DIG. 26; 40/489, 611

[56] References Cited

U.S. PATENT DOCUMENTS

| | | | |
|---|---|---|---|
| 974,297 | 11/1910 | Richardson | 40/611 |
| 1,099,748 | 6/1914 | Hopkins | 434/413 |
| 1,167,715 | 1/1916 | Preo | 40/489 |
| 1,437,315 | 11/1922 | Kelly | 40/617 |
| 1,965,580 | 7/1934 | Dill | 434/421 |
| 2,092,323 | 9/1937 | Myers | 434/421 |
| 2,507,857 | 5/1950 | Johnson | 40/624 |
| 2,727,746 | 12/1955 | Hawkes | 116/225 X |
| 3,178,834 | 4/1965 | Dyer et al. | 434/413 |
| 3,659,365 | 5/1972 | Eaton | 40/611 |
| 3,943,646 | 3/1976 | Branham | 40/611 X |
| 3,987,567 | 10/1976 | Fritts | 40/624 |
| 4,003,579 | 1/1977 | Miscavage | 273/148 |
| 4,251,936 | 2/1981 | Ferrell | 40/489 |
| 4,270,292 | 6/1991 | Eckberg II | 40/611 |
| 4,521,984 | 6/1985 | Murray | 40/611 |

OTHER PUBLICATIONS

"Chart Board Kit" article in p. 50 of the Sign of the Times, Dec., 1968 (column 1).

No. 206,964, "Bulletin Board for Recreation Grounds or Racecourses," Australia, Dec. 28, 1920.

Installation Instructions for Magna Track-2 pages, Magna Chart Catalog St. Louis, Mo. 1991 Catalog.

*Primary Examiner*—Daniel M. Yasich

*Attorney, Agent, or Firm*—Dowell & Dowell

[57] ABSTRACT

A scoreboard system for use in tournament play such as in golf, tennis and trap and skeet shooting events, which includes a plurality of scoreboard panels which are portable so as to be selectively moved between an outdoor support system and an indoor support system and wherein at least two of the scoreboard panels include two different player grid portions permanently displayed on the front and rear surfaces thereof for accommodating different types of tournaments having differing numbers of players and wherein the panels are reversible with respect to their support systems whereby, when the front surfaces are mounted in display relationship with respect to one another, a first grid pattern is established, and wherein, when the rear surfaces thereof are oriented in a display relationship, either a second or third grid pattern is created.

6 Claims, 5 Drawing Sheets

MULTIPURPOSE SCOREBOARD SYSTEM

BACKGROUND OF THE INVENTION

1. Field of the Invention

This invention is generally directed to scoreboard systems and, more specifically, to a scoreboard system which includes a plurality of panels constructed of generally lightweight material having porcelain finishes on both the front and rear surfaces thereof. At least two of the panels include two different tournament grid patterns permanently fired into the front and rear surfaces thereof so that when the panels are oriented in a first relationship with respect to one another a first grid pattern is established accommodating a first number of players participating in a medal or stroke play tournament and wherein, when the panels are reversed to display the opposite faces thereof, a second grid pattern is established for match play involving a first number of players. The panels are structured so that when the match play grid systems are rotated 180° relative to one another, a match play grid system for a second number of players is created.

In the preferred embodiment of the present invention, four scoreboard panels are detachably mounted to an outdoor frame or support which frame includes a track system for selectively supporting the panels with respect thereto. In the preferred system, each of the four panels has a first grid pattern permanently fired into the front face or surface thereof which grid pattern is normally designated as a stroke play grid system. Such stroke play grids are designed to accommodate up to forty players on each grid. Two adjacent panels also include a second grid pattern permanently fired into their rear surfaces. Each of the second grid patterns is designed for match play for thirty-two players. However, when the rear surfaces are oriented in a display configuration and rotated 180° relative to one another, a single grid pattern for match play for up to sixty-four players is created.

In the preferred system, at least one or more of the scoreboard panels includes a blank rear surface thereby allowing for any indicia to be placed thereon as is deemed necessary by tournament officials.

Because of the porcelain construction having the grid patterns etched or fired therein, any type of markers may be utilized to record information on the surface of the panel members, with such materials being easily wiped from the surface when a tournament is completed.

The system also incorporates an indoor track system which allows the panels of the present invention to be transported from the outdoor frame supports to an indoor system whenever desired. The invention is particularly adaptable for use with golf tournaments, but is also adaptable for use in tennis, trap and skeet shooting and other types of tournaments having multiple players or participants.

2. History of the Related Art

Over the years numerous scoreboard systems have been developed for reflecting the outcome of matches between players or participants in events which reflect the individual players and their scores during the progress of a given event. In a very basic scoreboard system, a frame is provided for supporting indicia indicating either the teams or players competing. Such systems include areas in which scores may be posted either by separate card, plate, or, in some instances, entered by use of chalk or other writing material. Variations of these most basic scoreboards continue to be used in many athletic and other competitive events. For instance, at many golf courses, tournament events are recorded on scoreboards that are generally constructed of plywood or other wooden material to which cardboard or other paper grid systems are secured. Information as to players and their progress by hole through the course of play is recorded by hand on the grid system attached to the plywood frame.

One of the drawbacks of these conventional basic scoreboard systems is that a separate overlay must be applied to the scoreboard each time an event is scheduled. Further, the use of paper or cardboard type materials to record the players' activities has several inherent drawbacks. First, if misinformation is accidently applied to the paper or cardboard, it is difficult to correct and maintain a sightly appearance to the scoreboard. Secondly, in the event of an outdoor tournament wherein the weather is inclement, it is difficult to protect the paper or cardboard from damage by wind and rain. Thirdly, the use of such materials to record tournament events does not permit scoreboard information to be easily moved and professionally displayed at an indoor location following the completion of an event or following the completion of a day's activities.

Over the years there have been many scoreboards developed for use in specific types of sporting or other tournament events. In some sports, it is economically feasible to utilize electronic and other sophisticated scoreboard systems to record the players' or teams' scores and other information during the course of play. However, in other sporting events, the use of such costly electronic display systems is not appropriate. For instance, in golf and trap and skeet shooting wherein tournaments may be played only at certain times of the year at any given facility, it is not cost effective to provide expensive electronic scoring systems and therefore use continues to be made of the more basic hand written type of scoring systems.

Unfortunately, hand type recording scoreboard systems have not changed nor developed to facilitate the ease of recording handwritten information nor have they developed to a point of allowing dual function or increased utility in the use of the scoreboard system for different types of tournament events. For instance, in golf, in some tournaments play is termed "medal" or "stroke" play and the players are generally playing against one another to determine who has the lowest score at the end of a given number of holes played. In stroke play, the scoreboards reflect the players' name and their respective scores by hole and may reflect an "out" score after nine holes, an "in" score after eighteen, and provision is often made for handicaps which affect the ultimate score at the end of stroke play. A typical grid system for stroke play is reflected in FIG. 4 of the drawings, although this grid pattern is applied to a particular panel used in the present invention. As opposed to "medal" or "stroke" play, other tournament events are "match" play events wherein winners progressively move towards one another in ladder play until ultimately two players meet to determine the winner of the tournament. In these types of events, it is the recording of the winners and losers of each round which is recorded and reflected on the scoreboard. A typical grid pattern for this type of play is shown in FIG. 5 of the drawings, however again, this grid pattern is applied to a particular panel member used in the present invention.

With conventional handwritten scoreboards currently used to record sporting and other competitive events there has been no provision made for accommodating different types of play, i.e. stroke play and match play, on a single scoreboard thus requiring the complete replacement of the cardboard or paper covering materials for each event.

SUMMARY OF THE INVENTION

This invention is directed to a scoreboard system for use in monitoring tournament play especially for events such as golf wherein the system incorporates a plurality of scoreboard panels which are lightweight and which are provided with porcelain front and rear surfaces or faces, and wherein first scoring grids for stroke play are permanently fired into the porcelain front face. In at least two of the scoreboard panels a grid system for match play is permanently fired into the rear faces thereof. Upon the reversal of one of the two panel members incorporating a match play grid system, a grid pattern is developed for use with up to thirty-two players. Upon the reversal of the other of the two scoring panels having the match play grid system thereon and upon its relative rotation through 180° with respect to the other of the two scoreboard panels incorporating match play grid system, a combined and aligned grid system for up to sixty-four players is created.

The scoreboard panels of the present invention are releasably supported from an outdoor support structure so that they may be moved to an indoor track system whereby the panels may be displayed indoors following an outdoor tournament. In some instances, supports may be provided for tilting or inclining the panels relative to the support structures or tracks so that the panels are inclined like an easel. The porcelain faces of the scoreboard panels allow various types of markers to be utilized to record the names and scores of the various players and also permits such indicia to be easily removed by wiping the panels clean following an event.

In some embodiments of the present invention, supplemental panels may be magnetically adhered to the primary scoreboard panels to reflect various calendar events associated with the club at which the scoreboard system is used.

BRIEF DESCRIPTION OF THE DRAWINGS

FIG. 2 also reflects that the reverse side of at least one or more of the panel members may have a blank surface to which any information may be selectively applied.

DESCRIPTION OF THE PREFERRED EMBODIMENT

Figure 1:
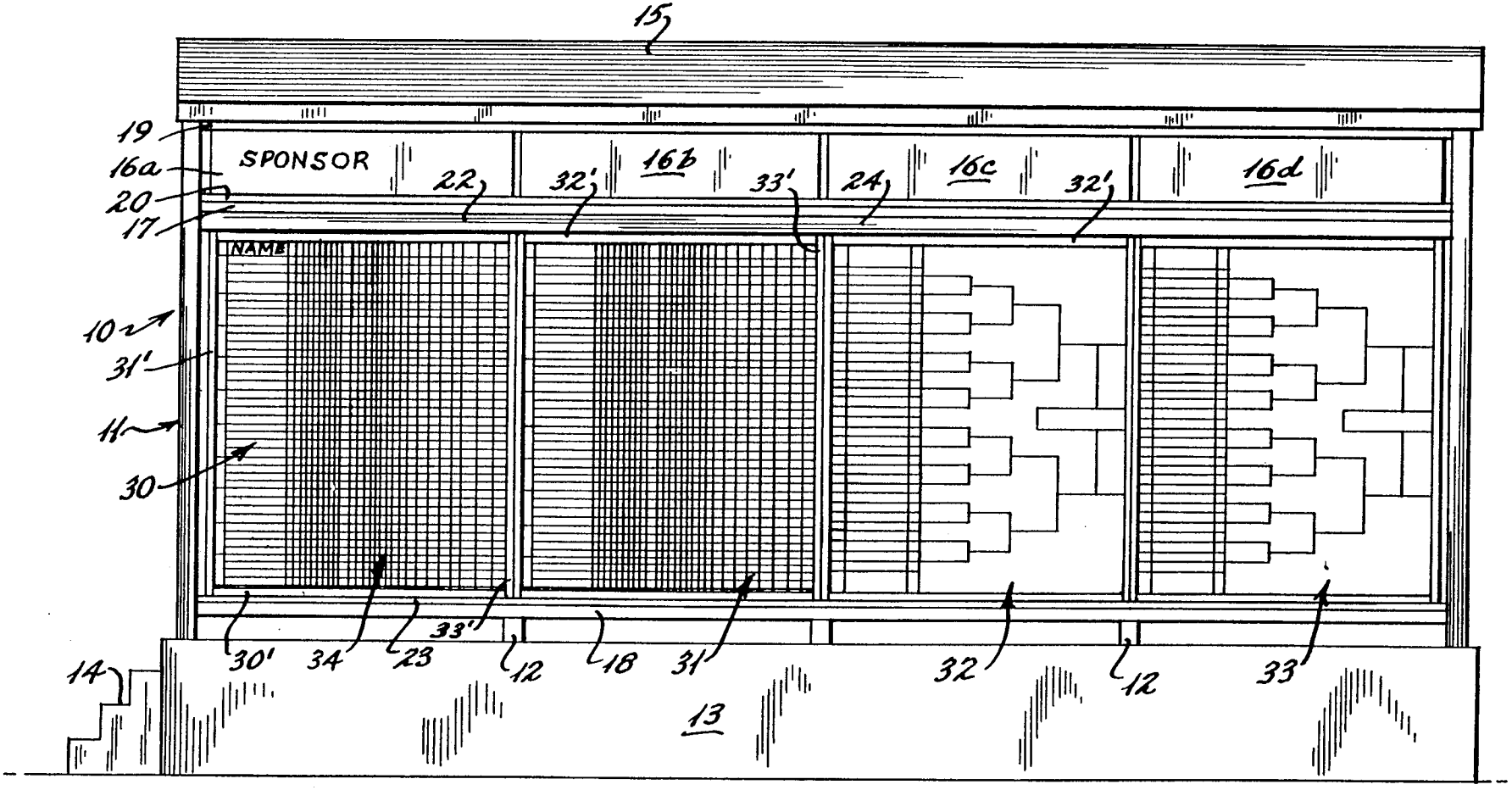
FIG. 1 is a front plan view of the scoreboard system of the present invention showing four (4) scoreboard panels mounted to an outdoor support structure and showing two of the panels to the left side oriented to show medal or stroke play and two panels on the right side oriented to show match play.

With continued reference to the drawings, FIG. 1 discloses an outdoor scoreboard system 10 developed in keeping with the teachings of the present invention. The scoreboard system includes a support frame structure 11 having a number of vertical support posts 12 which are either embedded directly into, the ground or are mounted to a walkway structure 13. In some instances, the walkway will be provided with a staircase 14. Mounted along the upper portion of the support posts will be an overhang or roofing structure 15 which extends outwardly from the front of the support frame. Mounted immediately below the roof 15 are a plurality of horizontally oriented display panels **16*a*–16*d* which may be utilized to record information such as a tournament sponsor, advertiser and the like. Mounted below the display panels is a first horizontal frame element 17 which is vertically spaced in relationship to a lower horizontal frame element 18**.

In order to support each of the panels **16*a*–16*d* with respect to the frame or support structure 10, a pair of elongated and opposing tracks 19 and 20 are provided in which the panels 16 are selectively inserted. The tracks 19 and 20 are generally open-ended so that the panels may be removed by sliding each panel longitudinally along the tracks. The panels are retained in plate by forming the upper track 19 in a generally U-shaped configuration and with the lower track 20 having an opposing U-shaped configuration. The legs forming the upper track should be somewhat vertically elongated with respect to the legs forming the lower track 20** so that, if necessary, the panels may be removed by raising the panels upwardly into the upper track and thereafter pivoting the panels outwardly with respect to the lower track. In this manner, an intermediate panel may be removed without sliding the remaining panels.

Figure 6:
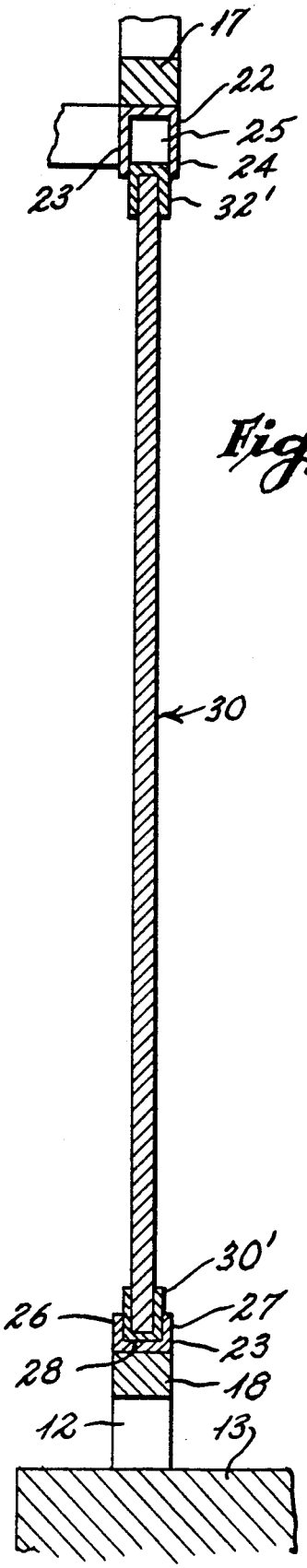
FIG. 6 is an enlarged view taken along lines 6—6 of FIG. 2 showing the outdoor mounting track system.

Mounted to each of the horizonal frame elements 17 and 18 are a pair of elongated opposing generally U-shaped track members 22 and 23, which are shown in cross section in FIG. 6. The upper track 22 includes a pair of elongated opposing leg portions 23 and 24 which are spaced to form an elongated channel 25 therebetween. In a like manner, track 23 includes opposing leg members 26 and 27 defining an elongated open channel 28 therebetween. The depth of the channel 28 is shown as being less than the depth of the channel 25 so that individual scoreboard panels 30, 31, 32 and 33 may be selectively mounted therein by inserting the upper edge of each panel member into the channel 25 and thereafter lowering the lower edge of the panels into the channel 28, as is shown in FIG. 6. In this orientation, the upper edge of each of the panels 30–33 will be retained within the pair of opposing tracks without the requirement of mechanical fasteners. Further, each of the panels 30–33 may be longitudinally shifted along the length of the opposing channels 22 and 23 to thereby realign the panels relative to one another as may be desired.

As previously discussed, the scoreboard system of the present invention provides a unique arrangement of separate scoreboard panels 30–33 which have various types of grid patterns formed on the front or first and rear or second surfaces thereof. Each panel is generally constructed with a lightweight frame to which front and rear porcelain surface panels are applied. In order to make the system versatile and portable, each panel is designed to measure apparently 4'×4' with a weight of approximately 24 pounds. Further, each of the panels is generally ¼" thick and is framed with a coated aluminum frame, 30'–33' (FIGS. 4 and 5), to protect the edges of each panel. Because of the porcelain front and rear surfaces, any type of marker may be utilized to write on the panels. Once markings have been applied to the panels, the markings may be easily removed either by wiping the panels or by use of a common solution for removing even indelible inks so that the panels may be utilized over and over again.

Figure 4:
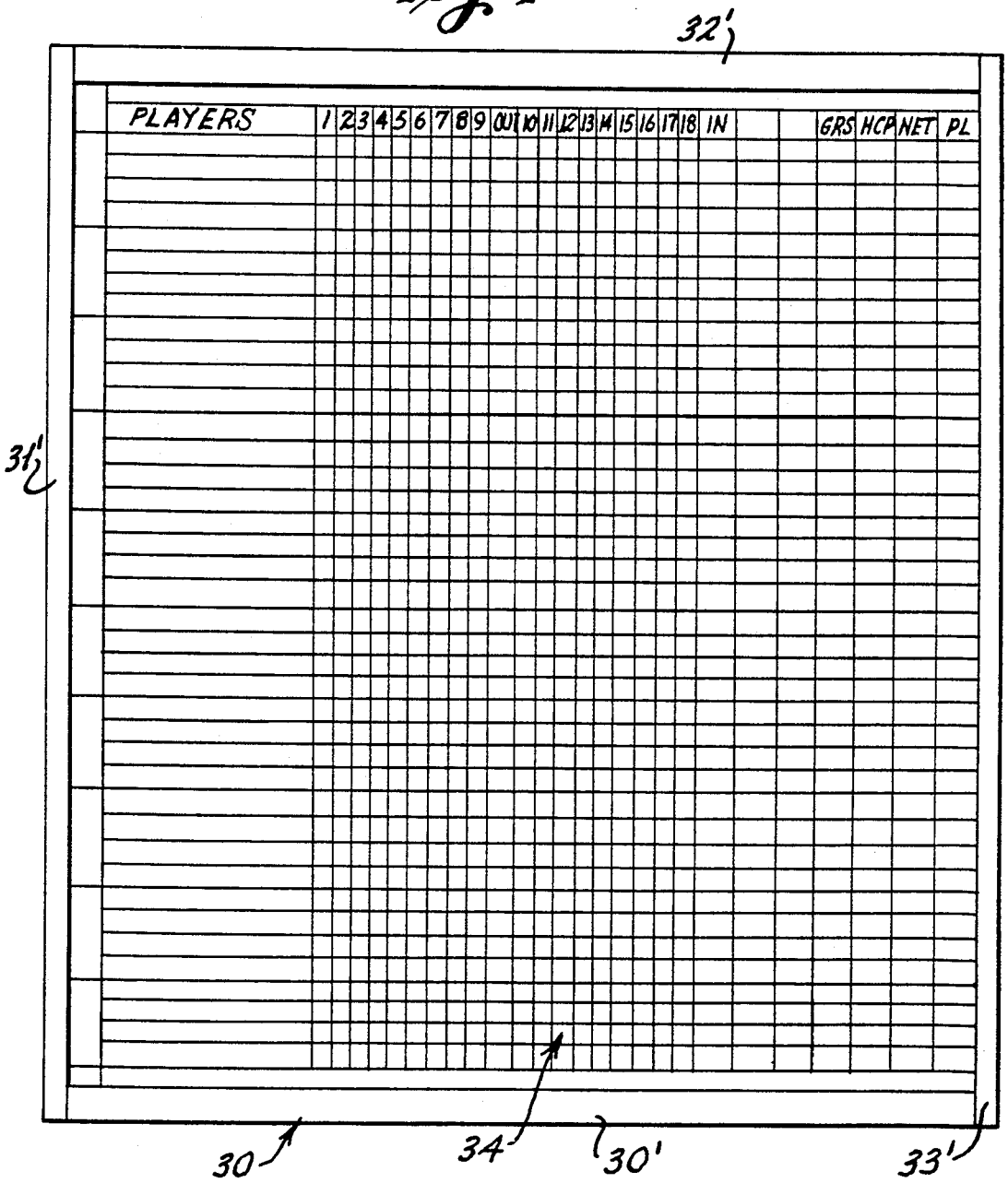
FIG. 4 is an enlarged view of the front face of each of the panels showing grid pattern for medal or stroke play.

With specific reference to FIGS. 1 and 4, each of the panels includes a front face having permanently fired or etched thereon a grid pattern 34 which is designed for medal or stroke tournament play. In this respect, the grid patterns 34 reflect a conventional scoring grid which may include space for players' names as well as space for recording, for example, in a golf tournament, the number of shots or strokes for each hole with an "out" score being reflected after nine holes and an "in" score reflected after eighteen holes. In addition, provision is made for a total tournament score, handicap and a reflection of net score and placement for the tournament. On a typical 4'×4' panel member 30, room is made for approximately forty players. Therefore, in a system utilizing four panels, a total of one hundred and sixty (160) players may be accommodated utilizing the scoreboard system of the present invention. It should be noted in FIG. 1 that the right two panels have been reversed so that the rear surfaces thereof are being displayed, it being preferred that each of the front surfaces thereof include the grid patter 34 reflected in FIG. 4.

Figure 2:
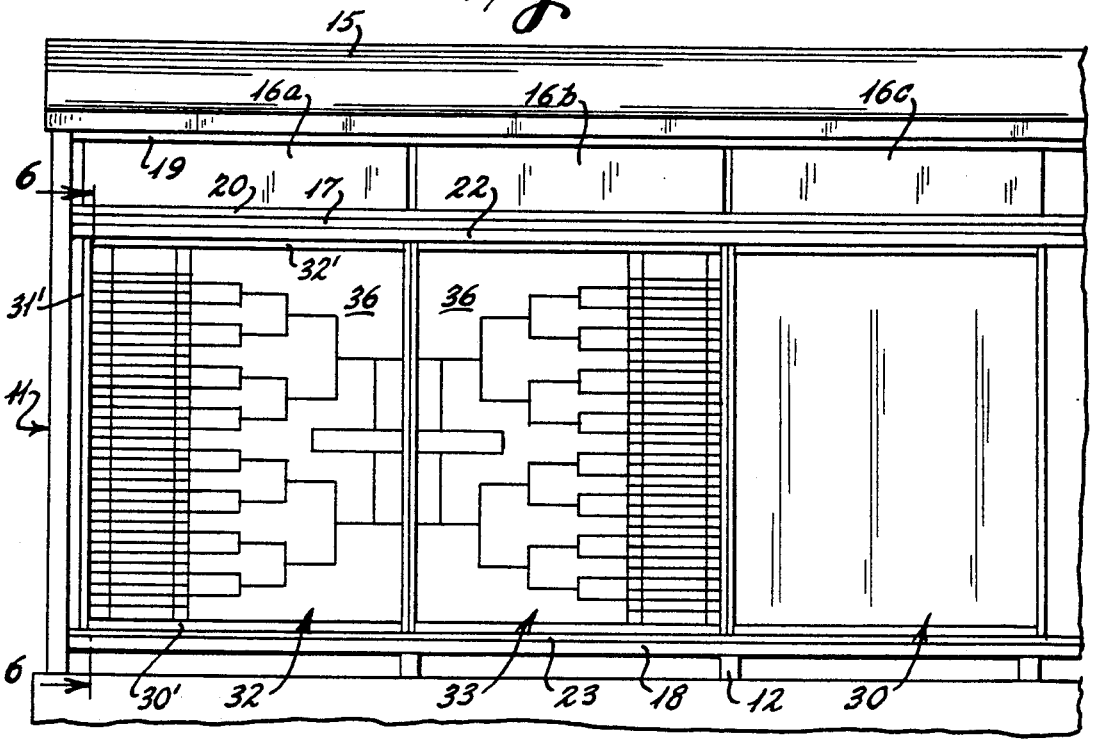
FIG. 2 is a partial front plan view of the scoreboard of FIG. 1 showing the two scoreboard panels on the right side of FIG. 1 being mounted to the left side of the system in FIG. 2 with one of the panel members being rotated reversely aligned relative to the other to thereby align the two match play panels to form a combined match play ladder.
Figure 5:
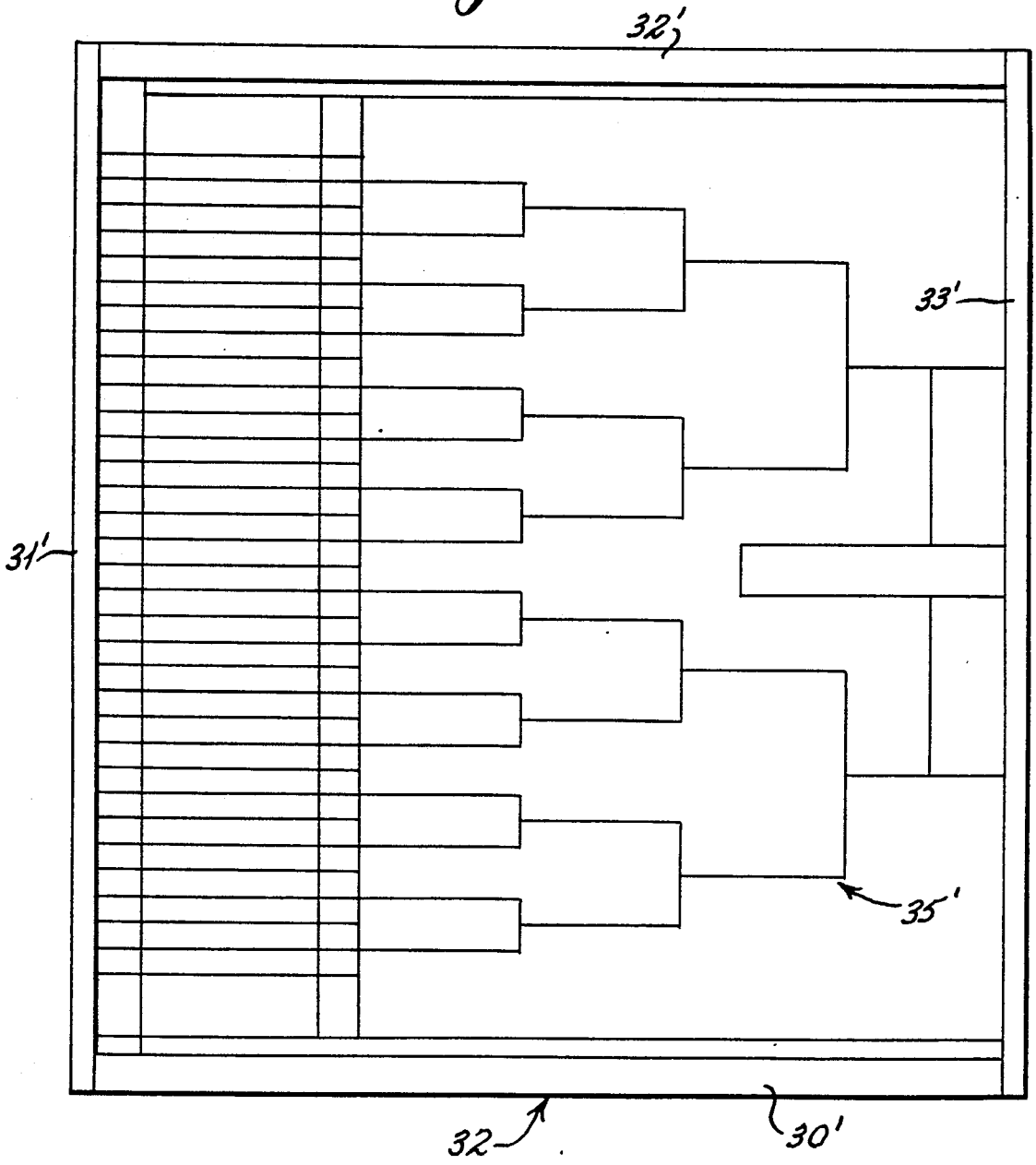
FIG. 5 is an enlarged front plan view showing the match play grid pattern of at least two of the panels of the present invention.

With specific reference to FIGS. 1 and 5, at least two of the panels, such as those shown at 32 and 33, include rear surfaces into which is permanently fired or etched a second grid pattern 35 as reflected in FIG. 5, which grid pattern is designed for "match" or ladder play. The grid patterns shown in FIG. 5 reflect space for thirty-two players in a ladder, with the advancement of winners being indicated in the grid pattern. In view of the foregoing, if a tournament is to be "match" play as opposed to "stroke" play, panel 32 may be utilized and positioned to the left side of the support structure, as shown in FIG. 2. In the event that more than thirty-two players are involved in "match" play, it is possible to orient the panels 32 and 33 to create an overall grid system to accommodate sixty-four players. As shown in FIG. 2, if panel 33 is reversed so that the match play grid pattern is oriented outwardly with respect to the support structure and thereafter rotated 180° relative to panel 32, the two patterns 35 thereon are aligned to form a combined third grid pattern 36 for the increased number of players and wherein players designated on panel 32 would be advancing to the right along the panel and wherein players designated on panel 33 would be advancing towards the left.

With further reference to FIG. 2, it is preferred that the panel members 30 and 31 include blank rear surfaces so that any indicia may be applied thereto by tournament officials. In some instances, it may be desired to include additional "match" play grid patterns 35 on one or more of these panels so that a total of four (4) match play panels could be incorporated in the scoreboard system of the present invention. Further, and although not shown in the drawings, the panels of the present invention are adapted to support separate magnetically attachable display panels which may include information such as a calendar of events for the facility or club at which the scoreboard system is in use.

Figure 3:
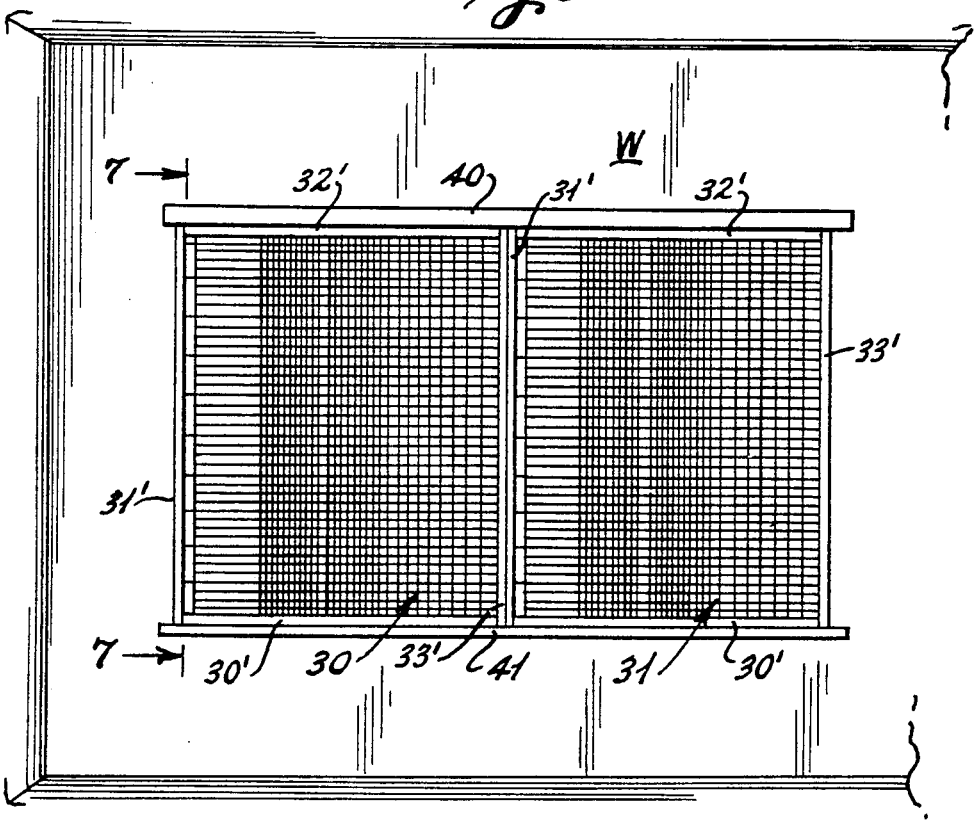
FIG. 3 shows the medal or stroke play panels of the present invention mounted to an indoor track system thereby allowing information to be displayed indoors following an outdoor event.
Figure 7:
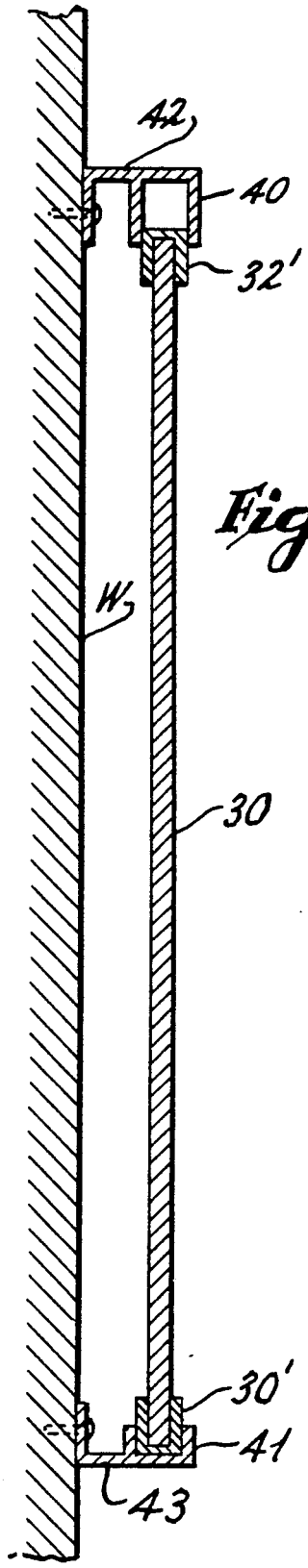
FIG. 7 is a view taken along lines 7—7 of FIG. 3 showing the indoor mounting track system of the present invention.

One of the advantages of the scoreboard system of the present invention is that the lightweight panels are easily transportable. In this respect, in many instances, it is desirable to reflect the status of a tournament after each day's play at an indoor location. Therefore, and as reflected in FIG. 3, the panels of the present invention are designed to be easily mounted within opposing tracks 40 and 41, which are mounted within a clubhouse or other structure and directly to a wall (W). Each of the opposing channel members 40 and 41 is generally similar in structure to the channels 22 and 23 with the exception that flange portions 42 and 43 are provided to space the channel members outwardly with respect to the wall to allow for clearance between the panels and the wall as is shown in FIG. 7.

From the foregoing, the scoreboard system of the present invention provides a utility not heretofore available in scoreboard systems especially associated with tournament play in golf and other events including trap and skeet shooting wherein different types of tournament play are possible. The present scoreboard system allows for the provision of up to a hundred and sixty (160) players to be accounted for in "medal" or "stroke" play wherein the front face of each of the panels 30–33 are oriented in an outwardly displayed orientation with respect to the support frame 11. In the event of "match" play, at least two of the panels, such as panels 32 and 33, are provided with match play grid patterns 35 on the rear surfaces thereof so that when the panels are removed from the tracks 17 and 18, and reversed so that their rear surfaces are displayed outwardly from the support structure 11, either a grid pattern for thirty-two members may be created or a combined grid structure for sixty-four players may be created by simply thereafter rotating one of the panels, 32 or 33, 180° relative to the adjacent panel as is shown in FIG. 2.

It should be noted that there could be other means by which the panel members may be secured to the support structure. As previously mentioned, in some instances to enhance the display of the panels, support rods or arms may be provided for extending the bottom edge of the panels outwardly from the support tracks so that the panels are inclined or tilted in much the same manner as if supported on an easel. It is important, however, that at least two of the panels be reversible so that the rear surfaces thereof may be displayed to accommodate a different type of tournament play. In addition, it is preferred that at least one of the two panels that are reversible be also rotatable relative to the adjacent panel so that a combined grid system may be created such as shown in FIG. 2, as opposed to the single grid systems shown in FIGS. 1 and 5. Again it is preferred that at least two of the panels include a blank rear surface for accepting the display of any indicia which tournament officials may wish to place thereon, however, in some instances, the rear surface of the additional panels may also include "match" play grid patterns 35 such as shown for panels 32 and 33.

I claim:

1. A scoreboard system for selective recording information with regard to players involved in a different types of tournament play comprising, a support structure, a plurality of independently moveable panels each having a first and a second surface and upper and lower edges, a support means for removably supporting each of said panels to said support structure, at least one of said panels having a first grid pattern permanently affixed to the first surface thereof for receiving written indicia reflecting one type of tournament play, and at least two of said panels having a second grid pattern permanently affixed to the second surface thereof of each for accepting indicia with respect to a second type of tournament play, one of said at least two panels being selectively invertible 180° relative to the other of said at least two panels so that its lower edge is positioned above its upper edge so that said second grid patterns are aligned to form a combined third grid pattern, whereby said panels may be aligned relative to one another to define three different grid patterns for recording information with regard to players involved in tournament play.

2. The scoreboard system of claim 1 in which each of said panels includes said first grid pattern on said front surface thereof.

3. The scoreboard system of claim 2 in which the front and rear surfaces of each of said panels are formed of porcelain.

4. The scoreboard system of claim 1 in which said support means for removably supporting said panels from said support structure includes a pair of elongated channel members which are oriented in opposing and spaced relationship with respect to one another, and each of said panels being slidably receivable between said channel members.

5. A scoreboard system for selective recording information with regard to players involved in different types of tournament play comprising, a support structure having front and rear portions, at least two independently moveable panels each having a first and a second surface and upper and lower edges, means for removably supporting each of said panels to said support structure so as to be selectively displayed relative to said front portion thereof, said panels having a first grid pattern permanently affixed to the first surface thereof for receiving written indicia reflecting one type of tournament play and having a second grid pattern permanently affixed to the second surface thereof for accepting indicia with respect to a second type of tournament play, said panels in a first orientation displaying said first grid patterns outwardly relative to said front portion of said support structure, said panels being selectively reversible to a second orientation display said second grid pattern outwardly relative to said front portion of said support structure, and one of said panels being invertible relative to the other so that said lower edge thereof is above said upper edge to thereby realign said second grid patterns to form a third combined grid pattern, whereby said panels may be religned relative to one another to define three different grid patterns for recording information with regard to players involved in tournament play.

6. The scoreboard system of claim 5 in which said means for removably supporting said panels from said support structure includes a pair of elongated channel members which are oriented in opposing and spaced relationship with respect to one another, and each of said panels being slidably supported by said opposing channel members.

* * * * *